US006027192A

United States Patent [19]

Irace

[11] Patent Number: 6,027,192

[45] Date of Patent: Feb. 22, 2000

[54] MOLDED PANELS FOR CABINETS

[76] Inventor: Francisco D. Irace, 6225 SW. Kendale Lake Cir. No. D-152, Miami, Fla. 33183-0000

[21] Appl. No.: 09/102,330

[22] Filed: Jun. 22, 1998

[51] Int. Cl.[7] ..... A47B 47/00

[52] U.S. Cl. ..... 312/263; 312/205; 312/257.1

[58] Field of Search ..... 312/107, 108, 312/111, 257.1, 205, 263, 264, 265.1, 265.2, 265.3, 265.4, 265.5, 265.6; 52/592.1, 592.3, 589.1, 79.5, 270, 284; 220/4.28, 4.31, 4.33

[56] References Cited

U.S. PATENT DOCUMENTS

| | | | |
|---|---|---|---|
| 2,072,383 | 3/1937 | Rottman | 312/263 |
| 2,601,634 | 6/1952 | Rivette | 312/257.1 X |
| 3,435,575 | 4/1969 | Pottiez | 312/263 X |
| 3,567,300 | 3/1971 | Mari | 312/257.1 |
| 3,810,430 | 5/1974 | Siegal | 312/264 X |
| 3,974,616 | 8/1976 | Beckley | 52/656.1 |
| 4,288,132 | 9/1981 | Znamirowski et al. | 312/263 X |
| 4,616,890 | 10/1986 | Romick | 312/265.1 |
| 4,664,283 | 5/1987 | Liu . | |
| 5,076,454 | 12/1991 | Garton et al. | 220/4.28 X |
| 5,360,263 | 11/1994 | Nakano et al. | 312/257.1 |
| 5,435,644 | 7/1995 | Schuh et al. | 312/257.1 |
| 5,642,923 | 7/1997 | Meacham et al. | 312/263 X |
| 5,782,044 | 7/1998 | Dodd et al. | 52/592.1 X |

*Primary Examiner*—Peter M. Cuomo
*Assistant Examiner*—Hanh V. Tran
*Attorney, Agent, or Firm*—J. Sanchelima

[57] ABSTRACT

A system for building metallic cabinets of different dimensions with a minimum of inventory for parts that includes first and second panels, used in pairs and kept in opposite spaced apart relationship with respect to each other by connecting bottom and top panels. The first and second panels include interlocking longitudinally extends slots and mal rib members that can be readily assembled and, optionally, extension panels removably mounted in between the first and second panels. In the space defined by these panels, a number of accessories can be readily suspended, such as shelves, hinge assemblies and the like, at any position by using fasteners mounted along longitudinally extending slots internal in said space on the opposite surfaces of the panels. Cover panels and back panels are slidably mounted along cooperating rails and slots, respectively, located on predetermined positions of the first and second panels.

8 Claims, 3 Drawing Sheets

MOLDED PANELS FOR CABINETS

BACKGROUND OF THE INVENTION

1. Field of the Invention

The present invention relates to a system with a plurality of molded panels for building cabinets, and more particularly, metallic cabinets.

2. Description of the Related Art

Building all metal cabinets require customizing them for particular applications. Many times, secondary operations at the installation site are required for positioning accessories, such as hinge assemblies, shelves, etc. These accessories typically require drilling holes at precise positions. The present invention obviates these problems by providing a flexible system that permits a user to readily assemble cabinets of different dimensions without requiring drilling holes to position these accessories at almost unlimited positions within the cabinet space. The present system also obviates the logistics associated with manufacturing, storing and transporting a large inventory of different parts.

SUMMARY OF THE INVENTION

It is one of the main objects of the present invention to provide a plurality of molded panels having an interlocking mechanism to assemble them to build cabinets.

It is another object of this invention to provide molded panels that have such structures that permit a user to fasten them with screw members, or the like, in any desired position without the need of drilling holes, specially for accessories desired by the end user. The finished cabinet can be readily fabricated and assembled on site conforming to the particular dimensions.

It is another object of this invention to provide molded panels that minimize assembly time and the logistic associated with a large inventory of parts.

It is still another object of the present invention to provide molded panels for cabinets that provide an internal finished surface defining the cabinet's space.

It is yet another object of this invention to provide molded panels for cabinets that are inexpensive to manufacture and maintain while retaining its effectiveness. The molded panels are delivered to the end user as a finished product.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figures 1, 11:
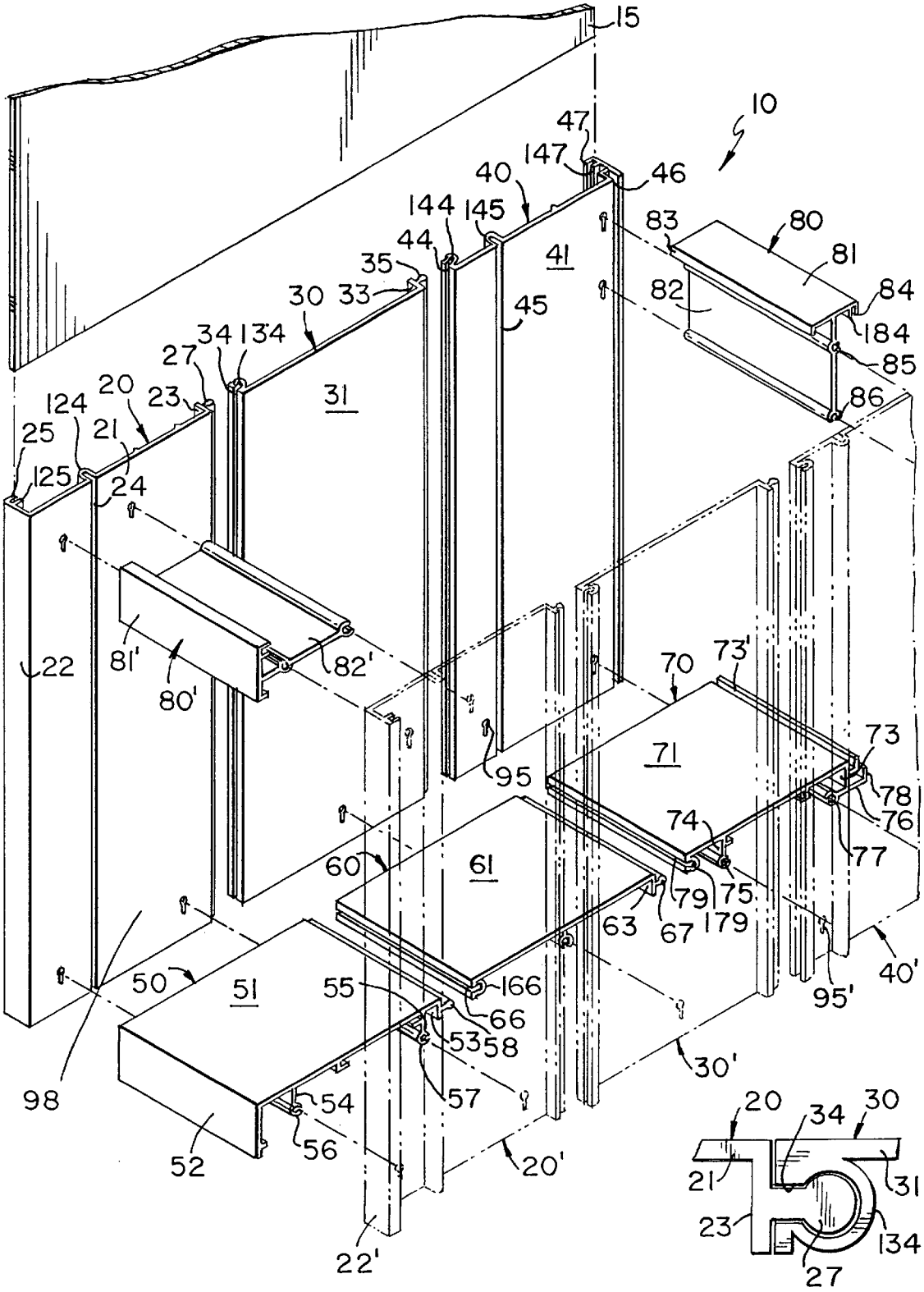
FIG. 1 is an exploded view of the molded panels that are used to build a cabinet.
FIG. 11 is a partial elevational side view of one of the female and male members in interlocking engagement.

Referring now to the drawings, where the present invention is generally referred to with numeral 10, it can be observed that it basically includes a plurality of molded panel assemblies 20; 30; 40; 50; 60; 70 and 80 that are mounted to each other by their interlocking mechanisms and fastening members. Assemblies 20; 30 and 40 are interlocked to each other defining one side wall. Assemblies 20'; 30' and 40' are similarly interlocked forming an opposite side wall at a spaced apart and parallel relationship with the other wall. Panel assemblies 50; 60 and 70 are interlocked to each other defining the bottom wall of the cabinet. Spacer top panel assemblies 80 and 80' are mounted at spaced apart relationship with respect to each other, and with panel members 50; 60 and 70 keep the opposite sides separated defining an interior compartment for the cabinet.

Figure 2:
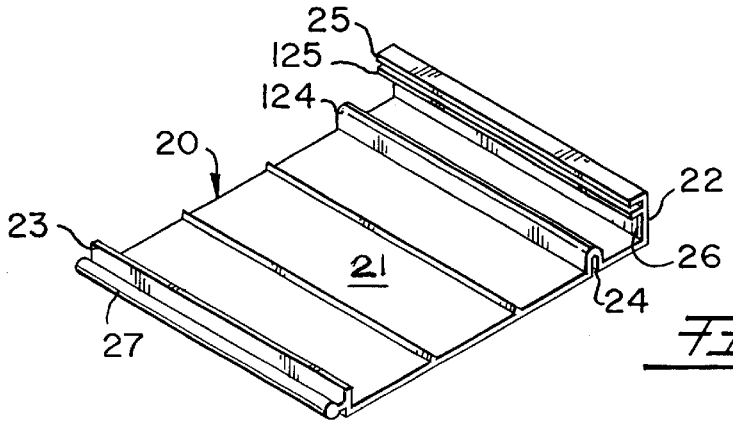
FIG. 2 is an isometric view of a front side panel.
Figure 10:
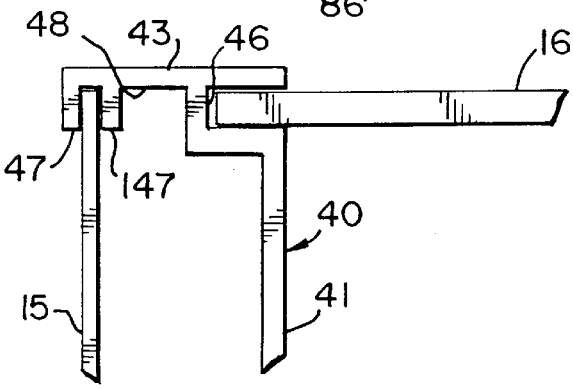
FIG. 10 is a partial top view of the panel assembly 40 with flat panels or covers 15 and 16 mounted thereto.
Figure 9:
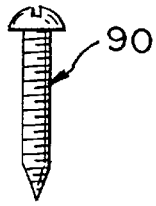
FIG. 9 is an elevational view of a fastening member used in the present invention.

As illustrated in FIGS. 1 and 2, panel assembly 20 is positioned on one side. Molded panel assembly 20 includes main wall 21, front wall 22 and rear wall 23. Main wall 21 includes, on its inner surface, extending longitudinal slot 24 with corresponding outwardly extending longitudinal channel 124 along the entire length, in the preferred embodiment. Longitudinal channel 124 is designed to snugly and cooperatively receive fastening members when mounting a table top, hinge assemblies, shelves, or other accessory members. The fastening members can be mounted at any desired positions (height) along channel 124, thereby avoiding the inconvenience of drilling holes in main wall 21. Front wall 22 has rails or guiding members 25 and 125 inwardly and perpendicularly mounted on inner surface 26. Rails 25; 125 and 47; 147 of assembly 40 permit a user to mount flat panel or cover 15 to cabinet 10, as shown in FIGS. 1 and 10. Rear wall 23 includes elongated interlocking male rib 27 that extends outwardly therefrom. Elongated interlocking male rib 27 is cooperatively inserted in longitudinal interlocking female member or longitudinal slot 34 of panel assembly 30 by coaxially aligning them and sliding member 27 through slot 34. In this manner, molded panel assembly 20 is mounted to molded panel assembly 30, as shown in FIGS. 1 and 11. Member 27 includes a longitudinally extending protuberance at its distal end. Slot 34 slidably receives the longitudinal protuberance of member 27.

Figure 3:
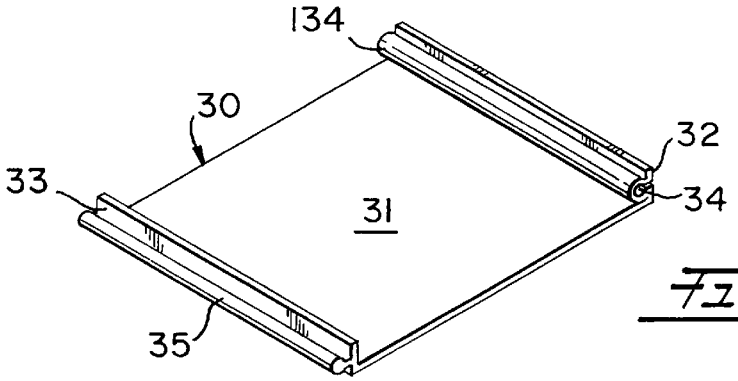
FIG. 3 is an isometric view of a side panel in the central section.

Molded panel assembly 30, as illustrated in FIGS. 1 and 3, includes main wall 31, front wall 32 and rear wall 33. Front wall 32 has longitudinal slot 34 and longitudinal channel 134 that define the longitudinal interlocking female member to engage with elongated interlocking male rib 27. Rear wall 33 includes outwardly extended elongated interlocking male rib 35 that is cooperatively inserted in another adjacent molded panel assembly 30, if needed, or inside longitudinal interlocking female slot 44 of molded panel assembly 40. In this manner, molded panel assemblies 20; 30 and 40 form one of the lateral walls of cabinet 10.

Figure 4:
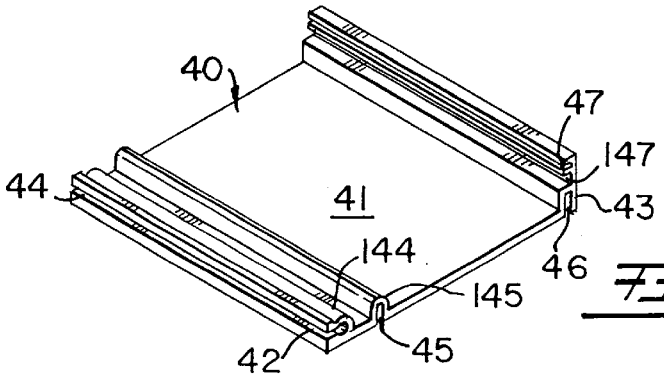
FIG. 4 is an isometric view of a rear side panel.

Molded panel assembly 40, as illustrated in FIGS. 1 and 4, includes main wall 41 with two ends having front wall 42 and rear wall 43 perpendicularly mounted thereon. Front wall 42 has slot 44 and longitudinal channel 144 defining the longitudinal interlocking trough for engagement with elongated interlocking male rib 35, as above described. Similar to longitudinal channel 124 and slot 24 in molded panel assembly 20, assembly 40 includes longitudinal slot 45 and longitudinal channel 145 to snugly and cooperatively received fastening members. This permits a user to perpendicularly mount another panel (or shelf) inside the cabinet 10 and be sandwiched between panel assemblies 20; 30; 40 and 20'; 30'; 40', as best seen in FIG. 1. Panel assembly 40 with its rear wall 43 form a section of the back wall of cabinet 10. Rear wall 43, in the preferred embodiment, includes slot 46 and rails 47 and 147 located in inner surface 48 of wall 43. Slots 46 and 46' (of panel assembly 40') have rectangular cross sections and permit panel 16 to slide along.

Figure 5:
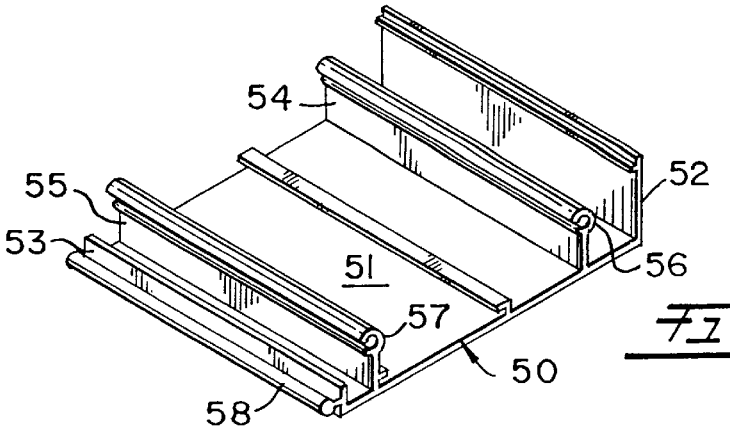
FIG. 5 is an isometric view of a front bottom panel.

Molded panel assembly 50, as illustrated in FIGS. 1 and 5, includes main wall 51, front wall 52 and rear wall 53. Molded panel assembly 50 also includes walls 54 and 55 that are perpendicularly mounted to upper wall 51. Walls 54 and 55 are positioned at a spaced apart and parallel relationship to each other. Walls 54 and 55 have, at their distal edges, C-shaped elongated tubular members 56 and 57, respectively. C-shaped elongated tubular members 56 and 57 are intended to receive fastening members 90 and 90' (in the same way is done for panel assembly 70 shown in FIG. 7) to mount panel assembly 50 to panel assemblies 20 and 20'. Rear wall 53 includes outwardly extended elongated interlocking male rib 58. Elongated interlocking male rib 58 is cooperatively inserted inside longitudinal interlocking female slot 66 and longitudinal channel 166 of panel assembly 60. In this manner, molded panel assembly 50 is mounted to molded panel assembly 60, as shown in FIG. 1.

Figure 6:
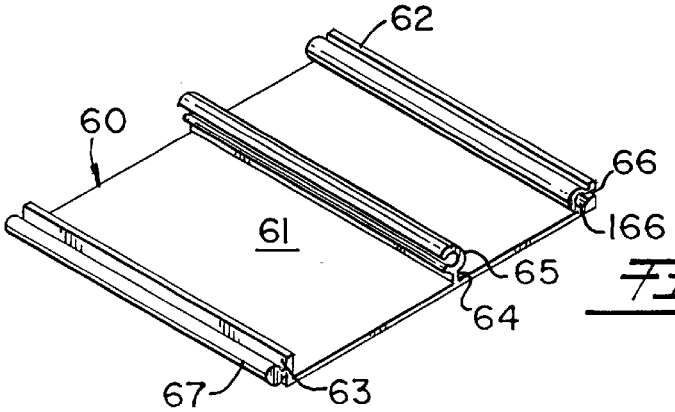
FIG. 6 is an isometric view of a bottom panel in the central section.

Molded panel assembly 60, as illustrated in FIGS. 1 and 6, includes main wall 61, front wall 62 and rear wall 63. Molded panel assembly 60 also includes wall 64 that is perpendicularly mounted to main wall 61. Wall 64 has, at its distal edge, C-shaped elongated tubular member 65. C-shaped elongated tubular member 65 is intented to receive fastening member 90 and 90' to mount panel assembly 60 to panel assemblies 30 and 30'. Front wall 62 has slot 66 and longitudinal channel 166 that define the longitudinal interlocking female member for engagement with elongated interlocking male rib 58 of panel assembly 50, as above described. Rear wall 63 includes outwardly and perpendicularly extended elongated interlocking male rib 67. Elongated interlocking male rib 67 is cooperatively inserted in another of a similar molded panel assembly 60, if needed, or inside longitudinal interlocking female slot 79 of molded panel assembly 70. In this manner, molded panel assemblies 50; 60 and 70 form the bottom wall of the cabinet.

Figure 7:
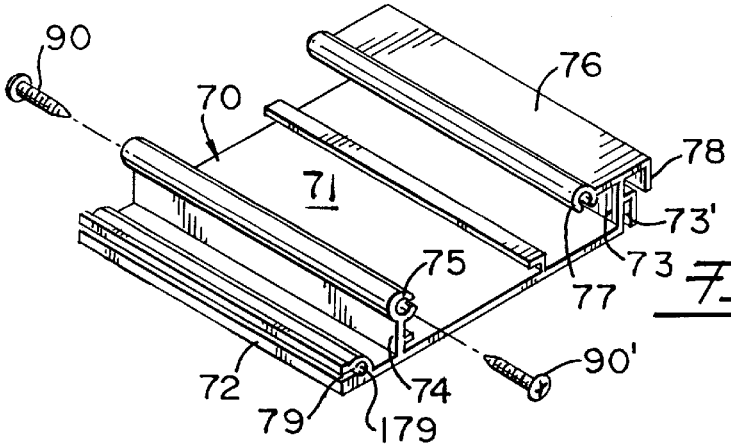
FIG. 7 is an isometric view of a rear bottom panel.

Molded panel assembly 70, as illustrated in FIGS. 1 and 7, includes main wall 71, front wall 72 and rear wall 73. Molded panel assembly 70 also includes wall 74 that is perpendicularly mounted to main wall 71. Wall 74 has, at its distal edge, C-shaped elongated tubular member 75. Rear wall 73 has wall 76 perpendicularly mounted thereon. Wall 76, in the preferred embodiment, has at one end, C-shaped elongated tubular member 77 mounted thereon and flange 78 perpendicularly mounted at the other end. C-shaped elongated tubular members 75 and 77 are intented to receive fastening members 90 and 90' to mount panel assembly 70 to panel assemblies 40 and 40'. Fastening members 90 and 90' pass through openings 95 and 95' that are located in panels 40 and 40', respectively, as shown in FIG. 1. Front wall 72 has longitudinal slot 79 and longitudinal channel 179 that defines the longitudinal interlocking female member to engage with elongated interlocking male rib 67 of panel assembly 60, as above described. Rear wall 73 also includes slot 73' mounted thereto. Slot 73' is in alignment with slots 46 and 46' (not shown in drawings) so that flat panel or cover 16 can be slid through. Slot 73' of panel assembly 70 receives the lower edge of panel 16. Panel 16 along with rear wall 43 conform the back wall of cabinet 10.

Figure 8:
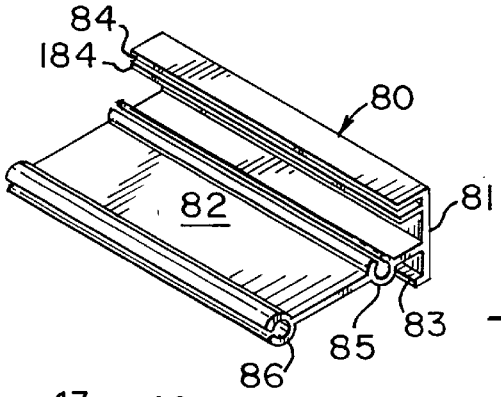
FIG. 8 is an isometric view of a top spacer panel that is used in the front and rear sections of the cabinet.

Spacer top panel assembly 80, as illustrated in FIGS. 1 and 8, basically includes wall 81 perpendicularly mounted to wall 82. Wall 81 has mounted, at one end, inwardly extending flange 83 and rails 84 and 184 at the other end. Slot or guiding members 84 and 184 receive the edges of panel 16. Panels 15 and 16 dress cabinet 10 providing the outside finish. Wall 82 includes C-shaped elongated tubular members 85 and 86. C-shaped elongated tubular members 85 and 86 cooperatively receive fastening members 90 and 90' that permit to fasten and secure panel assembly 80 to assemblies 40 and 40'. FIG. 1 illustrates panel assemblies 80 and 80' mounted to the front and rear sides conforming the frame of cabinet 10, as illustrated in FIGS. 1 and 10. Spacer molded panel assembly 80' is similar to assembly 80. Spacer molded panel assembly 80' includes front wall 81' and perpendicularly extending wall 82'. Walls 22; 22'; 52 and 81' defines the outline of opening 98 through where the user has access to the interior of cabinet 10.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for building cabinets, comprising:

A) two first panel members each including a first main wall having a substantially rectangular shape with first inner and first outer surfaces, and also having first, second, third and fourth sides each, and each first main wall further including first front and first rear walls perpendicularly mounted to said first and second sides, opposite to each other, and each of said rear walls including a longitudinally extending first interlocking male rib member having a round longitudinal protuberance;

B) two second panel members each including a second main wall having a substantially rectangular shape with fifth, sixth, seventh and eighth sides each, and further including second front and second rear walls perpendicularly mounted to said fifth and sixth sides, opposite to each other, and each of said second front walls having an internal and an external surface, said internal surface having a longitudinally extending channel and defining a corresponding longitudinally extending first slot on said external surface, said first slot having cooperative dimensions to slidably receive said longitudinally extending protuberance of the first interlocking male rib member thereby defining a space therein;

C) at least two bottom panel members having a substantially rectangular shape connecting said third sides of the two first main walls of said first panel members to said seventh sides of said two second main walls of said second panel members; and D) at least two top panel members having substantially rectangular shape and at least one of said two top panel members connecting said fourth sides of the said two first panel members, wherein each of said first front walls includes a first internal surface having a first pair of longitudinally extending rails perpendicularly mounted thereon and each of said second rear walls includes a second internal surface having a second pair of longitudinally extending rails peripendicularly mounted thereon.

2. They system set forth in claim 1 wherein at least one other top panel member is connected to said eight sides of said two second panel members.

3. The system set forth in claim 2 wherein each of said first and second main walls including first, second, third and fourth longitudinally extending channel on said outer surfaces parallel to said first, second, fifth and sixth sides, respectively, and said channel defining a corresponding longitudinal slot on said inner surfaces, and further including first fastening means removably mounted along said longitudinal slots for mounting at least one accessory assembly within said space.

4. The system set forth in claim 3 wherein said each of said top and bottom panels include at least one C-shaped tubular member transversely mounted on said top and bottom panels substantially adjacent to the edges of said top and bottom panels, and said first and second panels include a corresponding plurality of cooperating openings in alignment position with said C-shaped tubular members, and further including a plurality of second fastening means passing through said openings and in cooperative removable engagement with said C-shaped tubular members.

5. The system set forth in claim 4 further including:

E) at least one pair of extension panel members each having a substantially rectangular shape with ninth, tenth, eleventh and twelfth sides, said ninth and tenth sides being opposite to each other, said ninth sides having longitudinally extending channels extending inwardly with corresponding outwardly positioned second slots that cooperatively receive said first male rib members, and said tenth sides having a longitudinally extending second male rib members cooperatively receivable within said first slots so that said extension panel members are mounted between said first and second panel members thereby increasing said space.

6. The system set forth in claim 5 and further including a cover panel member of cooperative substantially rectangular dimensions receivable between said first and second pairs of rails.

7. The system set forth in claim 6 wherein each of said second panel members includes a longitudinally extending third slot substantially adjacent to said second rear walls, and further including a back panel member of cooperative substantially rectangular dimensions receivable between said third slots of said second panel members.

8. The system set forth in claim 7 wherein said bottom panel members include fourth slots cooperatively positioned to receive said back panel member, and said top panel members including fifth slots cooperatively positioned to receive said back panel member.

* * * * *